US008668298B2

(12) United States Patent
Buschmann

(10) Patent No.: US 8,668,298 B2
(45) Date of Patent: Mar. 11, 2014

(54) METHOD TO IMPROVE THE PRINT QUALITY OF AN INKJET PRINTER

(75) Inventor: Stefan Buschmann, Poing (DE)

(73) Assignee: Océ Printing Systems GmbH, Poing (DE)

( * ) Notice: Subject to any disclaimer, the term of this patent is extended or adjusted under 35 U.S.C. 154(b) by 198 days.

(21) Appl. No.: 12/881,814

(22) Filed: Sep. 14, 2010

(65) Prior Publication Data

US 2011/0069101 A1 Mar. 24, 2011

(30) Foreign Application Priority Data

Sep. 18, 2009 (DE) ..... 10 2009 042 209

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS

| | | | | |
|---|---|---|---|---|
| 5,192,959 | A * | 3/1993 | Drake et al. | 347/42 |
| 6,561,622 | B1 * | 5/2003 | Suzuki et al. | 347/35 |
| 7,216,947 | B2 | 5/2007 | Kusunoki | |
| 2005/0062774 | A1 * | 3/2005 | Kusunoki | 347/9 |
| 2005/0146543 | A1 * | 7/2005 | Smith et al. | 347/6 |
| 2007/0182773 | A1 * | 8/2007 | Kim et al. | 347/9 |
| 2008/0084447 | A1 * | 4/2008 | North et al. | 347/19 |
| 2009/0167794 | A1 * | 7/2009 | Hosono et al. | 347/6 |
| 2010/0091053 | A1 * | 4/2010 | Jackson et al. | 347/9 |

FOREIGN PATENT DOCUMENTS

| | | | | |
|---|---|---|---|---|
| DE | 69912571 | T2 | 6/2000 | |
| DE | 602004006812 | T2 | 3/2005 | |
| DE | 10 2007 035 805 | A1 | 5/2009 | |
| EP | 1038677 | A1 * | 9/2000 | B41J 2/165 |
| JP | 2005254709 | | 9/2005 | |

* cited by examiner

*Primary Examiner* — Geoffrey Mruk
*Assistant Examiner* — Bradley Thies
(74) *Attorney, Agent, or Firm* — Schiff Hardin LLP

(57) ABSTRACT

In a method to improve print quality of an ink printer, ink droplets of predetermined size are ejected by an ink print head via a nozzle. A time duration is determined since a last ejection of an ink droplet. The size of a next ink droplet to be ejected is controlled depending on the determined time duration.

7 Claims, 3 Drawing Sheets

METHOD TO IMPROVE THE PRINT QUALITY OF AN INKJET PRINTER

BACKGROUND

The disclosure concerns a device and a method to improve the print quality of an ink printer, in particular what is known as a drop-on-demand ink printer, in which individual drops are generated and expelled from a nozzle only as needed.

In such drop-on-demand ink printers, the danger exists that ink starts to dry in the nozzles after longer periods of non-use of the nozzle, and this can lead to the clogging of the nozzle. Since a portion of the fluid evaporates more and more over time, this leads to an increase of the viscosity, whereby an ink droplet to be expelled takes somewhat longer until it is expelled or the ink flow velocity is reduced. Such a droplet therefore strikes the recording medium later. If a nozzle is clogged, an image point (pixel) will not be printed at all. Print errors can arise to a significant degree as a result of this.

Numerous methods as to how the clogging of nozzle channels of ink printers can be prevented are known from the prior art. From EP 1 038 677 A1 a method is known in which every nozzle is observed as to how long it has been since an ink drop has been expelled. If this length (what is known as a dead time) is greater than a predetermined limit value, the nozzle or the ink print head is moved into a park position in which the nozzle is then flushed with a larger ink drop.

A method to avoid the drying out of nozzles is known from the disclosure document DE 10 2007 035 805 A1. The ink print head is thereby not moved into a cleaning position; rather, the cleaning of the nozzles is conducted during the print operation. For this ink droplets are emitted from nozzles according to a predetermined algorithm. These ink droplets overlap on the recording medium with an image point that has already been printed beforehand or an image point that is still to be printed at the same point. All seldom used nozzles are thus always flushed with ink again and cleaned without the print image being conspicuously visibly affected.

It is also known that some image points on one side of the nozzles are printed at arbitrary, random points on the recording medium. A certain "noise" of image points is thus created in the background that should hardly stand out, however. Nevertheless, a degradation of the image quality exists, in particular given high graphical requirements.

A method to flush the nozzles is likewise known from the patent document U.S. Pat. No. 6,561,622 B1. In this an ink print head with the nozzles is moved into a park position and there the nozzles are flushed through with different ink volumes.

All of these known methods deal with the cleaning of the nozzles. There it is thus prevented that ink channels dry out completely. After a short non-use period of a nozzle, the viscosity of the ink can already critically increase so much that errors can be established in the print image as a result of the altered viscosity of the ink.

SUMMARY

It is an object to achieve a method and a device to improve the print quality of an ink printer in which even slight viscosity changes of the ink are taken into account.

In a method to improve print quality of an ink printer, ink droplets of predetermined size are ejected by an ink print head via a nozzle. A time duration is determined since a last ejection of an ink droplet. The size of a next ink droplet to be ejected is controlled depending on the determined time duration.

DESCRIPTION OF THE PREFERRED EMBODIMENT

Figure 1:
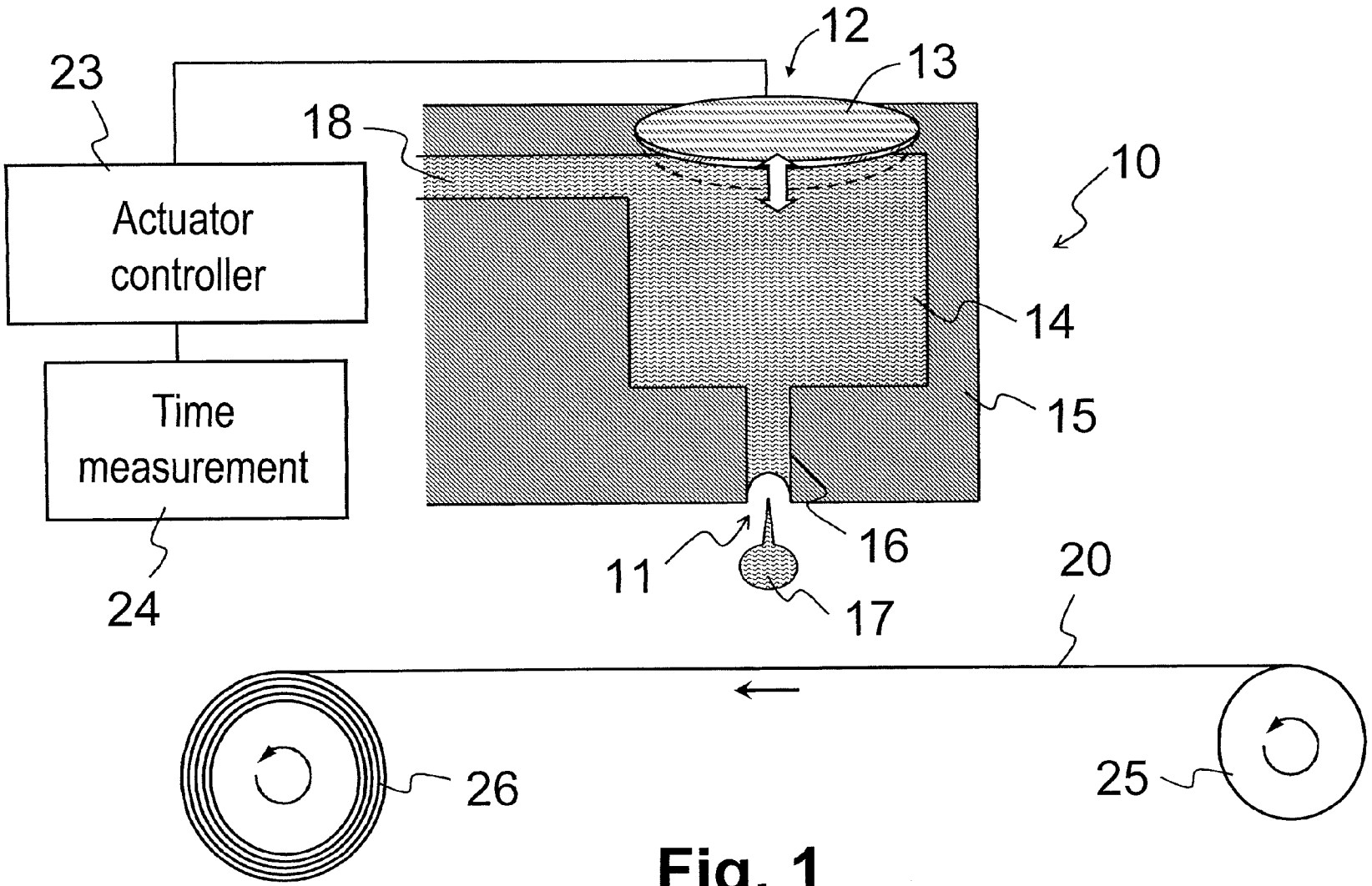
FIG. 1 is a block diagram of a device according to the preferred embodiment to improve the print quality of an ink printer.

For the purposes of promoting an understanding of the principles of the invention, reference will now be made to the preferred method embodiment/best mode illustrated in the drawings and specific language will be used to describe the same. It will nevertheless be understood that no limitation of the scope of the invention is thereby intended, and such alterations and further modifications in the illustrated method and such further applications of the principles of the invention as illustrated as would normally occur to one skilled in the art to which the invention relates are includes.

An ink print head with its nozzles is thereby controlled by an actuator controller to eject ink droplets. The actuator controller is connected with a measurement device that detects the time since the last ejection of ink through an ink channel (and thus through an ink nozzle). If the determined time (designated as dead time in the following) exceeds a predetermined threshold, the size or the volume of the next ink droplet to be ejected is adjusted depending on this dead time, and the actuator is controlled accordingly.

The ink print head thus has a piezo-element that is charged via a voltage in order to eject an ink droplet from the nozzle. The varied size of the ink droplet can thereby be set in advance or be altered continuously or in stages depending on the dead time.

The section through an ink print head 10 in the region of a nozzle 11 is shown in FIG. 1. The ink print head 10 is thereby shown in a very schematic manner for the purpose of clarification and is shown with exaggerated enlargement relative to the other parts.

In this exemplary embodiment the ink print head 10 has an electromechanical transducer, what is known as an actuator 12 with a piezo-element 13. The piezo-element 13 expands upon being charged with an electrical voltage and contracts again afterwards if the voltage is removed or its polarity is reversed. Via the expansion (marked by the double arrow and the dashed line in FIG. 1) an ink chamber 14 in a housing 15 of the ink print head 10 that is filled with ink is mechanically placed under pressure (the volume of the ink chamber 14 is compressed). An ink droplet 17 is thereby expelled with high velocity through a nozzle channel 16 of a nozzle 11 that is open to the outside insofar as the piezo-element 12 compresses the ink chamber 14 with sufficient strength and quickly enough.

If the piezo-element 13 contracts, a negative pressure arises in the ink chamber 14 and ink is refilled into the ink chamber 14 via an ink feed channel 18. The same volume and pressure relationships therefore predominate in the ink chamber 14 again at the next expansion, and an ink droplet 17 can again be reproducibly generated in terms of its size.

Figure 2B:
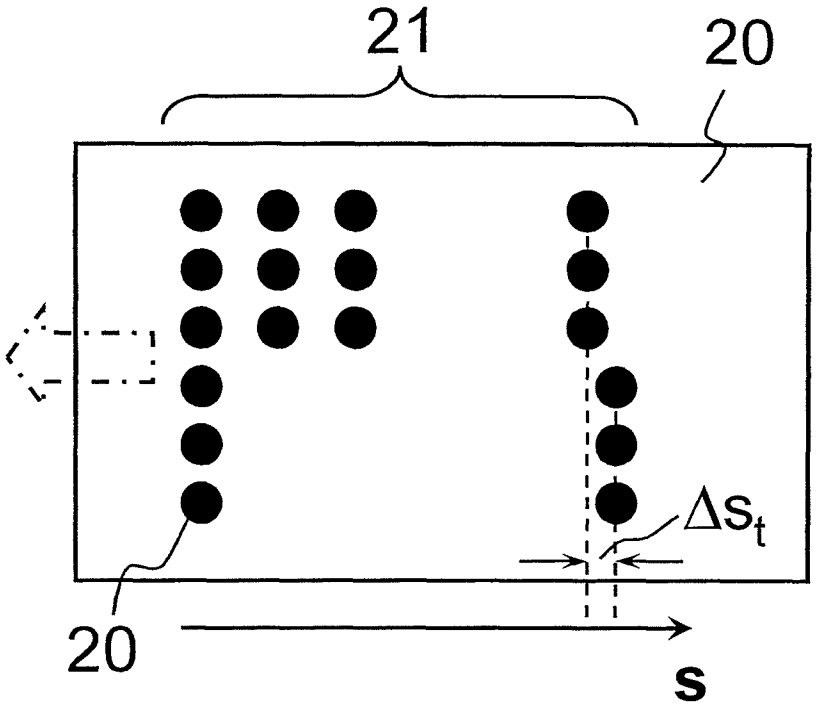
FIGS. 2*a* and 2*b* are illustrations of the print data or the resulting print image without compensation.

The ink droplet 17 flies along the extent of the nozzle channel 16 in the direction of a recording medium 20 that should be provided with a desired print image 21 (see FIG. 2*b*). After a short flight time, the ink droplets 17 strike the recording medium 20. The generation of the ink droplets 17 is set in advance depending on the generation of the droplets, the flight time (distance between nozzle 11 and recording medium 20) and a relative movement of nozzle 11—recording medium 20, such that the ink droplet 17 strikes precisely at the desired location on the recording medium 20.

The actuator 12 is controlled by the actuator controller 23 with corresponding electrical control signals depending on the image points 22 to be printed (see FIG. 2*b*). For this voltage pulses with predetermined amplitude, predetermined frequency, predetermined rise or fall flanks, predetermined repetition rate and/or predetermined pulse duration are applied to the actuator 12. All of these parameters, together with the geometry of the ink print head and the material properties of the ink, can affect the ink droplets 17 with regard to its size, its shape and ejection velocity.

Furthermore, the device has a time measurement 24 that determines a dead time $\Delta t_T$ of a nozzle 11. For this the time duration can be measured that has passed since the ejection of the last ejected ink droplet 17 of a nozzle 11. What is to be understood by the dead time $\Delta t_T$ is thus that time duration that lies between the ejection of two successive ink droplets 17 of the same nozzle 11.

The recording medium 20 on which the print image 21 is printed can have the form of a web as it is shown in FIG. 1. There the recording medium 20 is unrolled by an unroller 25, transported through the ink printed by means of a suitable transport device (thereby moved past the nozzle 11 relative to this) and rolled up again by a roller 26. After printing of such webs, these can also be post-processed, i.e. cut into individual sheets and stacked or enveloped after the cutting, for example.

Page-shaped or sheet-shaped recording medium 20 (individual pages, sheets) can likewise be used that are moved past the nozzle 11.

Instead of the movement of the recording medium 20 past the nozzle 11, the ink print head 10 can also be moved over the recording medium 20.

The time to generate the droplet, the flight time of a droplet and the relative velocity of recording medium 20 must be taken into account in the control of the actuator 12 so that the ink droplet 17 lands at the correct point on the recording medium 20. The time until the ink droplet 17 releases from the nozzle 16 and the flight time depend on the viscosity of the ink, on the surface tension of the ink, the dynamic of the activation signal and the geometry of the nozzle 11 and the ink chamber 14, as well as the material properties of the ink are taken into account.

The surface tension of the ink can be adjusted in advance via additives that are added to the ink. The geometry of the nozzle 11 and the ink chamber 14 can be accordingly established in advance such that a droplet of specific size and shape is generated given a reference control signal, the droplet flying to the recording medium 20 with a specific velocity (assuming the viscosity of the ink droplet 17 is always the same).

However, the viscosity can change quickly if no ink droplets 17 have been ejected from the nozzle channel 16 for a long period of time. In particular, a portion of the ink begins to vaporize at the exit of the ink nozzle channel. The viscosity of the ink thereby begins to increase in this region. The longer the time of non-use (i.e. the greater the dead time $\Delta t_T$), the more viscous the ink in this region. This can lead to a drying out/clogging of the entire nozzle channel 16. Ink droplets 17 can then no longer be ejected through the nozzle channel 17. In principle, the drying out of the nozzle channel 16 should be prevented since otherwise the ink print head 10 must be exchanged or cleaned in an expensive manner.

So that the ink in the nozzle channel 16 does not dry out entirely, various known methods to prevent the clogging of the nozzle 11 can be applied in addition to the method according to the preferred embodiment to improve the print quality by varying the ink volume after a longer dead time $\Delta t_T$.

Ink droplets 17 can thus be printed with random distribution across the recording medium 20. However, depending on the size these droplets are easily visible in the background, whereby the print image 21 is degraded in terms of its quality. Ink droplets 17 can also be printed on top of image points 22 of a different color that have already been printed, whereby quality losses in the print image 21 can barely be detected. However, the ink print head 10 can also be moved into a park position (not shown). There the nozzle 11 can be flushed. However, this negatively affects the time duration until a complete print job is printed to completion since the nozzle must always be cleaned again occasionally. If the time is too long (i.e. the print job is executed to completion), the print quality can possibly suffer significantly from this since the one or another seldom used nozzle 11 is possibly already clogged.

Figure 2A:
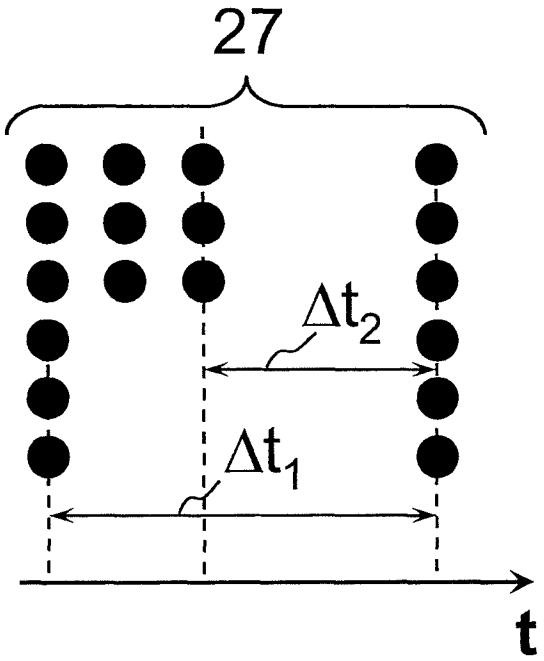

As is apparent from FIGS. 2*a* and 2*b*, print errors can already arise if the viscosity of the ink changes due to longer non-use time (dead time $\Delta t_T$). In FIG. 2*a* print data 27 (depicted there as black points) are shown in their time distribution corresponding to the desired print image 21 that should be printed as points on a recording medium 20. The print data 27 that are delivered in a print data stream then serve to control the corresponding ink print heads 10 in order to generate a print image 21.

All image points 22 together yield the print image 21 (FIG. 2*b*) that is shown in FIG. 2*b* corresponding to its spatial position (path s).

Figure 3B:
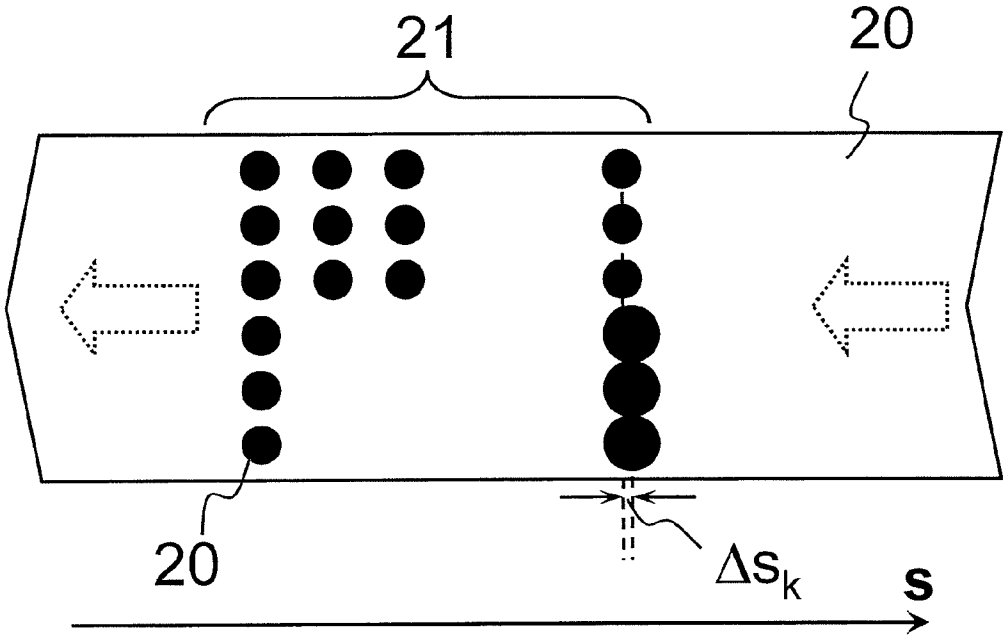
FIGS. 3*a* and 3*b* are illustrations of the print data or the print image resulting therefrom if the method according to the preferred embodiment has been applied.

Assuming that the recording medium 20 moves from right to left (indicated by the dotted arrow) relative to the ink print head 10 in FIGS. 2*b* and 3*b*, the points in the horizontal row represent those print data (FIG. 2*a*) for the correspondingly printed image points 22 (FIG. 2*b*) that should be printed in chronological order by a nozzle 11. The image points 22 in the vertical direction originate from directly adjacent nozzles 11.

Corresponding to the print data 27, three respective image points 22 are initially printed in the print image 21 (FIG. 2*b*) by the uppermost three nozzles 11, and an image point 22 is printed again after a short interval (corresponding to a pause=dead time $\Delta t_T$). The lower three nozzles 11 have printed only the first ink droplets and then another, single image point 22 is respectively printed again after a longer pause (another four print points could be printed between them).

This pause, which is also designated as a wait time (or dead time $\Delta t_T$) is the actual time period that passes between the ejection of two successive ink droplets 17 from one and the same nozzle 11.

If a nozzle should eject ink droplets 17 without interruption, two successive droplets always have a small separation from one another (depending on the parameters of the ink print head 10 and the material properties of the ink) whereby the maximum print speed and resolution is provided. The minimum (based on the technology) separation of two image points 22 (i.e. the maximum possible resolution) is thus shown in FIG. 2*b* in the upper left region.

If ink droplets 17 are continuously generated with highest resolution, ink is thus continuously and intermittently ejected from the nozzle 11. The viscosity of the ink at the exit of the nozzle channel 16 can therefore barely change so much as to be noticeable.

However, if not every possible print point is printed, but rather (due to the desired print image 21 to be printed) there is a dead time $\Delta t_2$ between two successive ink droplets 17 that lasts longer than a predetermined threshold $\Delta t_s$, the viscosity of the ink has already increased slightly. The threshold $\Delta t_s$ is thereby established such that the viscosity change is still tolerable after a shorter dead time $\Delta t_1$ but can yield noticeable delays in the generation and during the flight of the ink droplets 17 given a longer dead time $\Delta t_2$.

The dead time $\Delta t_1$ of the upper three nozzles 11 between the third and fourth ejected droplets is still within a tolerance limit (below the threshold $\Delta t_s$) within which the viscosity increase is still acceptable and no noticeable print image degradation is present yet.

It is assumed that the dead time $\Delta t_2$ between the first and the second ejected droplets of the lower three nozzles 11 is already so large that viscosity changes become noticeable in the print image 21. The dead time $\Delta t_2$ here is already above the predetermined threshold $\Delta t_s$; and print image errors are already recognizable in the actual print image 21. As a result of the increased viscosity, the ink droplets 17 land on the recording medium 20 later (separated from the desired position by an interval $\Delta s_t$) and thus do not lie on a line with the upper three pixels 22.

As shown in FIG. 2*a*, image points 22 printed by the right column of the print data 27 should be printed lying on a line. Since the drop formation by the lower three nozzles 11 takes longer as a result of the increased viscosity, and the flight time to the recording medium 20 occurs later as a result of the viscosity change (ink droplets 17 are also smaller), the line no longer appears straight but rather is divided and offset. It is now necessary to compensate these errors as much as possible.

In the event that only a single ink droplet 17 generates an image point 22, the ink droplets 17 have a pre-established size without any compensation. The size is set in advance and is dependent on the desired area of the image point 22. The properties of the ink and the absorption capability or penetration depth of the ink in the recording medium 20 are thereby taken into account.

Figure 3A:
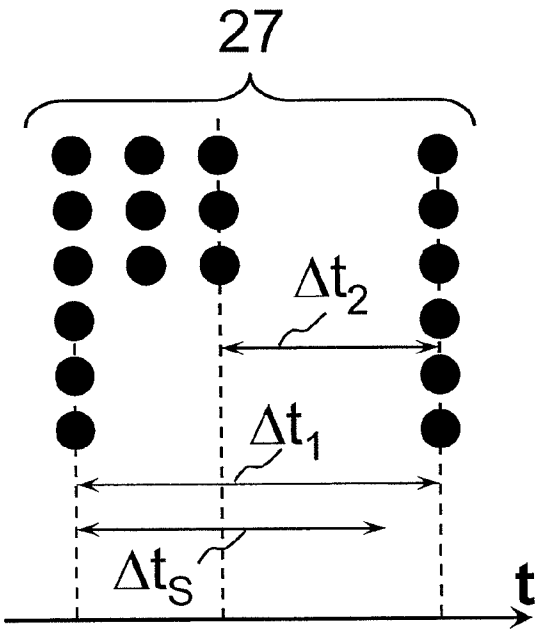

As is apparent in FIG. 3*a*, the print data 27 that are to be printed are the same as in FIG. 2*a*. In order to now compensate for the errors due to the increased viscosity as a result of the long dead time $\Delta t_2$, ink droplets 17 that should only be ejected after a time duration longer than the threshold $\Delta t_s$ are initially increased in terms of their size or their volume. The ink droplet 17 is now generated more quickly in the nozzle 11 due to this volume increase and also flies more quickly to the recording medium 20.

Due to such a compensation the ink droplets 17 with increased viscosity land on the recording medium 20 earlier than the original (uncompensated) ink droplets 17. Although the "compensated" image points 22 thus appear larger in the print image 21, they are again closer to the intended desired line in terms of their center points (with a spacing $\Delta s_k$ that is markedly smaller relative to the uncompensated spacing $\Delta s_t$). The line to be printed now appears straighter to the eye, even if the lower image points 22 are somewhat larger. The print image 21 was thus improved in terms of its quality, even if a nozzle 11 had a somewhat longer dead time $\Delta t_T$ (i.e. therefore had not printed for a longer time).

The droplet size can thereby be hard set as soon as the threshold $\Delta t_s$ is exceeded. The ink droplet 17 is in any case larger than that droplet that was emitted before the threshold $\Delta t_s$ was exceeded. The droplets can also (always) be enlarged proportional to the increase of the time duration in which no ink droplet 17 was ejected. The droplets can also be increased in stages (stepped) the longer that the dead time $\Delta t_T$ lasts. For example, the droplet size to be generated can be increased by a small stage (for example ink droplet 17 increased by 1/10) for every half second that the dead time $\Delta t_T$ lasts longer beyond the threshold $\Delta t_s$, such that at the end a total value for the size of the ink droplet 17 results depending on the total dead time $\Delta t_T$.

The dead time $\Delta t_T$ can be measured via the time measurement 24 that is connected with the actuator controller 23. The time measurement 24 can also be arranged integrated into the actuator controller 23. As soon as a control signal for the actuator 12 has been generated, a counter in the time measurement 24 can be started whose count status is continuously polled. As soon as the count status exceeds a time duration corresponding to the threshold $\Delta t_s$, the next droplet to be generated is varied in their size as soon as it is generated. The viscosity can already have critically risen so far that print image 21 would be degraded in terms of its quality.

Instead of directly measuring the dead time $\Delta t_T$, this can also be indirectly determined via the "unprinted" path. For this the number of the "unprinted" pixels can be counted via the actuator controller. The minimum separation of two pixels thereby corresponds to the maximum resolution. The number of non-image points can be read out from the data stream or can be detected by counting the nonexistent control signals for the actuator 12 as soon as an ink droplet should be expelled again with the same nozzle 11. Depending on how often the nozzle 11 has not ejected any ink droplet, the dead time $\Delta t_T$ then results as a multiplication of the integer number of the non-image points with the minimum separation of two pixels.

The dead time $\Delta_T$ could alternatively or additionally be measured by a sensor in the nozzle channel 16. An optical measurement is also possible in which the flying ink droplets 17 or the print points 22 located on the recording medium 20 (or the nonexistent print points) are optically detected and it is established how long it has been since a nozzle 11 has not ejected an ink droplet 17. The dead time $\Delta t_T$ is then provided to the actuator controller 23 in order to improve the print image quality.

In order to entirely avoid the drying out of a nozzle 11, known methods to flush or prevent the drying out of the nozzle 11 (anti-clogging) should additionally be applied in the event that the dead time $\Delta t_T$ extends longer than a limit value $\Delta t_G$ that is significantly larger than the threshold $\Delta t_s$. If the limit value $\Delta t_G$ is exceeded, ink droplets 17 are ejected by the nozzle channel 16 or the nozzle channel 16 is flushed with ink.

The method according to the preferred embodiment can also be used depending on the material properties of the ink that is used. Water-based inks (pigment or dye inks) change their viscosity more quickly than ultraviolet-curable inks. Additives can also be considered that affect the behavior of the ink with regard to viscosity. The threshold $\Delta t_s$ and the limit value $\Delta t_G$ can also be automatically or manually varied accordingly.

The threshold $\Delta t_s$ can be set depending on the ink at the start-up of the printer, for example via a control panel or by applying a corresponding control signal via an interface. Automatically adjusting devices can also be used in which the ink is analyzed and then a threshold $\Delta t_s$ is adjusted corresponding to the viscosity curve.

In the event that an ink print head 10 has multiple nozzles 11, each nozzle 11 can be monitored individually and the droplet sizes can be adjusted individually to compensate the print image or improve the print quality.

The method according to the preferred embodiment is independent of the color of the ink that should be printed by the ink print head 10. One or more ink print heads 10 can thus be used to print a color in a line. For different colors, the corresponding ink print heads 10 can be moved relative to the recording medium 20. The ink print heads for the different colors can also be arranged in a respective line, wherein the recording medium 20 moves past the ink print heads transverse to a line.

The method according to the preferred embodiment can also be used with MICR ink (Magnetic Ink Character Recognition), in which a document image is read magnetically, for example for bank checks. It is thereby particularly important that the letters are reproducible and can be clearly read magnetically. Since MICR characters do not occur often in a document, the danger exists that it is precisely the nozzles 11 for MICR ink that are prone to clogging or viscosity changes. Therefore it is advantageous if the MICR nozzles are specially monitored so that the MICR nozzles eject correspondingly enlarged ink droplets 17 in every case in the event that the threshold $\Delta t_s$ is exceeded.

Given customary inks it has been shown that a marked variation of the viscosity already results after one second of non-use of a nozzle, which variation leads to a noticeable print image variation (degradation of the print quality). The variation of the viscosity in the print image 21 becomes particularly noticeable given thin lines or sharp border regions of solid surfaces. It is therefore also possible to analyze the print data stream for precisely such objects to be printed. Those nozzles 11 that should print these critical objects can then be specially monitored for the dead times $\Delta t_T$ so that the next ink droplets 17 are corrected accordingly. In the print data stream, the print data 27 already exist some time before the actual generation of the corresponding ink droplets 17 and corresponding image points 22. The actuator controller 23 can therefore be promptly adjusted for the compensation.

The term "actuator" designates a transducer that transduces electrical signals into mechanical movement or into other physical quantities, such as pressure or temperature.

The ink printer is a printer in which ink droplets leave the nozzle (what are known as drop-on-demand ink printers). The ink droplets can also be generated by an actuator that transduces an electrical control signal into heat, whereby the ink in the region of a heating element is heated and a minuscule vapor bubble is generated in the manner of an explosion. An ink droplet is output from the nozzle via the arising pressure. Such ink printers are also called bubble-jet printers. Pressure valve printers can also be used in which individual valves are attached to the nozzles that open when an ink droplet should leave the nozzle. The method according to the preferred embodiment can be used in all of these types of drop-on-demand ink printers.

Recording medium webs (printers that use such recording medium webs are also called continuous feed printers) or even individual pages/sheets (printers that use such recording media are called cut sheet printers) can be transported as recording medium 20 through the printer and thereby be printed. Paper is advantageously used as a material. Plastic or metal films or other printable media can likewise be used.

The ink print head or heads 10 with one or more nozzles 11 and/or the recording medium 20 can be moved for printing. The nozzle 11 thus moves relative to the recording medium 20. In the print image 21, such errors in particular become noticeable as a result of the increased viscosity after a longer period when no ink is ejected, in which image points 22 on a fine line or a straight border region of a larger full tone area should be printed transverse to the movement direction.

If only the recording medium 20 is moved past the nozzles 11 on its way through the printer, the nozzles 11 should be arranged distributed over the entire printing width with an interval that corresponds to the print resolution (number of pixels per area). For this multiple ink print heads 10, possibly offset relative to one another, can form one print line. Multiple colors (for example according to the YMCK color printing method—yellow Y, magenta M, cyan C, black K) can be printed via multiple lines of ink print heads 10. Redundant lines of ink print heads 10 can also be present. In the event that a nozzle 11 should fail, a redundant nozzle 11 can be switched to print the same pixel position.

What are known as primers can also be printed with the ink print heads 10, via which a substance is applied onto the recording medium 20 before or after the printing of the color inks in order to avoid the penetration of the ink into the recording medium 20, for example, or to make this as minimal as possible. Additional customer-specific colors can also be printed.

The size of an ink droplet 17 thereby means the physical dimensions or the volume of the droplet. If the size is varied, more or less ink is consequently ejected, such that more or less ink arrives at the recording medium 20.

The method to compensate for print image errors and improve the print image quality as a result of a modified viscosity can also be applied if an image point 22 (pixel) is composed of multiple ink droplets 17. Each grey tone or semitone of a print point can be generated via rastering, for example with the aid of what is known as the multilevel technique. A pixel is thereby composed of multiple ink points via a rastering technique. A larger number of grey levels can therefore be generated in the print image 21 than given a single ink droplet 17.

Given multilevels, the size of an image point 22 can be generated via multiple ink droplets 17 that are ejected in succession and quickly, one after another, in part with different sizes. The ink droplets 17 can already merge into a single ink droplet 17 in flight. The ink droplet 17 can also overlap on the recording medium 20 so that a single image point 22 is inked. For compensation of the print image, one or more of the ink droplets 17 that ultimately form an image point 22 are ultimately increased in size in the event that a nozzle 11 has already not ejected any ink droplets 17 for longer than the threshold $\Delta t_s$.

Although a preferred exemplary method embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

I claim as my invention:

1. A method to improve print quality of an ink printer, comprising the steps of:

printing image points on a recording medium by ejecting corresponding ink printing droplets of predetermined volume by means of a stationary ink print head via a stationary nozzle corresponding to an image to be printed on said recording medium moving beneath the stationary print head;

determining a time duration since a last ejection of an ink printing droplet from the same stationary nozzle during printing; and increasing a volume of a next ink droplet to be ejected by the same nozzle during printing depending on said determined time duration such that the next ink droplet having increased viscosity compared to a previous droplet from the same nozzle lands on the recording medium earlier than an uncompensated droplet from that same nozzle since said next ink printing droplet of increased volume is generated more quickly in the nozzle and due to said increased volume flies more quickly to the recording medium than would the uncompensated droplet, said increased volume being selected such that a printed image point on said recording medium created by said next increased volume droplet is closer to an intended desired line formed by other printed image points.

2. The method according to claim 1 wherein the volume of the next ink droplet to be ejected is only varied after exceeding a predetermined threshold.

3. The method according to claim 1 wherein the volume of the next ink droplet to be ejected gets bigger as the determined time duration increases.

4. The method according to claim 3 wherein the volume of the next ink droplet to be ejected is varied continuously or in stages after exceeding a threshold depending on the determined time duration.

5. The method according to claim 1 wherein the volume of the next ink droplet to be ejected is hard set in the event that the threshold has been exceeded, wherein the volume of the next ink droplet is greater than that of the previous ejected ink droplet from the same nozzle.

6. The method according to claim 1 wherein a respective ink droplet is ejected from time to time by every nozzle of the ink print head after exceeding a limit value within which no ink droplet has been ejected from the respective nozzle in order to prevent a drying out of the ink in the nozzle, wherein the limit value is significantly larger than a predetermined threshold.

7. The method of claim 1 wherein a leading edge of said image point created by said increased volume droplet lines up with a leading edge of said other printed image points at said intended desired line.

* * * * *